United States Patent [19]

Piper

[11] Patent Number: 4,801,271

[45] Date of Patent: Jan. 31, 1989

[54] SAFETY COVER FOR ELECTRICAL OUTLETS

[76] Inventor: Danny A. Piper, R.R. 5, Box 3, Peru, Ind. 46970

[21] Appl. No.: 170,981

[22] Filed: Mar. 21, 1988

[51] Int. Cl.[4] ..... H01R 13/44

[52] U.S. Cl. ..... 439/148; 174/67; 439/142

[58] Field of Search ..... 174/67; 439/142, 143, 439/145, 148, 367

[56] References Cited

U.S. PATENT DOCUMENTS

| | | | |
|---|---|---|---|
| 2,407,894 | 9/1946 | Miller | 173/334 |
| 2,932,811 | 4/1960 | Abraham et al. | 339/38 |
| 3,387,252 | 6/1968 | Rothweiler | 439/148 |
| 3,876,273 | 4/1975 | Schwartz | 439/148 |
| 4,159,858 | 7/1979 | Toraya | 174/67 |
| 4,250,349 | 2/1981 | Bennett | 174/67 |
| 4,408,813 | 10/1983 | Koehler | 439/148 |
| 4,508,933 | 4/1985 | Carvel | 439/142 |
| 4,671,587 | 6/1987 | Lerner et al. | 439/142 |
| 4,760,215 | 7/1988 | Cook et al. | 174/67 |

*Primary Examiner*—Gil Weidenfeld
*Assistant Examiner*—Paula A. Austin
*Attorney, Agent, or Firm*—Woodard, Emhardt, Naughton, Moriarty & McNett

[57] ABSTRACT

A safety cover for electrical outlets with a dummy plug which is attached by a strap to a plate which is secured between the outlet and a cover plate. The dummy plug is designed with a socket contact surface that pivots one edge of the plug away from the socket when a force direct toward the socket is applied to the opposite edge.

10 Claims, 2 Drawing Sheets

SAFETY COVER FOR ELECTRICAL OUTLETS

BACKGROUND OF THE INVENTION

This invention relates to protective devices for electrical outlets and more particularly to a safety cover for electrical wall outlets.

This invention relates to safety covers which may be inserted into electrical outlets to prevent accidental or inadvertent insertion of metal objects such as pins and nails into the receptacle openings of the outlets.

There are several devices for covering electrical wall outlets, some of which are complex structures that are expensive to produce and awkward or inconvenient to use, others are simple devices which are merely dummy plugs. The complex devices often utilize sliding mechanisms with intricate moving parts or box-like housings which must be disconnected from the outlet to allow the insertion or withdrawal of the electrical plug into or out of the receptacles. The dummy plugs are intended for insertion into the outlet receptacles when the receptacles are not in use. These dummy plugs are intended to be difficult for a child to remove, however, it often turns out that the plugs are also very difficult for an adult to remove. Another disadvantage of these dummy plugs is that when removed from the outlet to allow the outlet to be used, the dummy plugs are often lost, misplaced or broken.

Two patents have been discovered which are believed to be of interest to the disclosed invention. The first is a patent issued to Miller (U.S. Pat. No. 2,407,894, issued Sept. 17, 1946) for an electrical connecting unit. The second is a patent issued to Abraham, et al. (U.S. Pat. No. 2,932,811, issued Apr. 12, 1960) for a safety cover for electrical outlets.

Miller discloses a device for running temporary electrical circuits which has dummy plugs received in the outlet receptacles when not in use. These dummy plugs are attached to the device by a cord 17 to prevent the loss of the dummy plug when removed from the outlet receptacle. While Miller does address the need for preventing the loss of dummy plugs, as stressed by this invention the Miller dummy plugs do not incorporate the unique pivotal arrangement that is used in this invention Miller has projections 11 around the contact 16 that are inserted into the outlet receptacle and these projections are snugly received in recesses 9 surrounding the receptacle which would prevent pivoting of the Miller dummy plugs. (Additionally, Miller relates to portable electrical circuits rather than to permanent electrical wall outlets.

Abraham discloses a one piece safety cover for a standard electrical wall outlet. The Abraham device is basically a plastic plate with a hole through it to receive the attachment screw used to secure the cover plate for the electrical outlet. The Abraham device is secured to the exterior of the cover plate by the same screw used to secure the cover plate. Located on opposite sides of the hole in the Abraham device are prongs which extend perpendicularly from the plate. These prongs are sized and arranged to be received in the receptacle openings in the outlet. Therefore, the Abraham device prevents the loss of the dummy plugs because these plugs are incorporated into the plate which is attached to the exterior of the cover plate for the electrical outlet. One disadvantage of Abraham is that when the dummy plug is removed from the receptacle openings, it is difficult to bend it back out of the way and therefore it interferes with insertion and removal of the electrical plug. Additionally, since Abraham's device is intended to be mounted to the exterior of the plate covering the outlet it is possible that if the dummy plugs are removed with sufficient force, then the counter sunk screw holding the device to the plate would pull through the flexible material from which this article is necessarily made.

SUMMARY OF THE INVENTION

One embodiment of the present invention is a safety device for insertion into the receptacle openings of a socket of an electrical outlet which has a plug head that has a protective surface and an oppositely facing socket contact surface. The plug head has a first edge and a second edge which is located opposite the first edge. The plug head has a pivot means for pivoting the second edge away from the socket in which the device is inserted when a force directed toward the outlet is applied to the first edge. The device has a plurality of prongs extending from the outlet contact surface. The prongs are positioned on the outlet contact surface to be received in the receptacle openings of the outlet.

A second embodiment of the present invention is a safety device to be used with a standard electrical wall outlet that has an outlet plate with a socket aperture and attachment aperture extending therethrough. The device has an electrically non-conductive plate with a socket opening and an attachment hole extending therethrough. The attachment hole and socket opening are sized and arranged to correspond with the attachment aperture and the socket aperture in the outlet plate. The device also has an electrically non-conductive plug with prongs located thereon which are positioned and sized to be received in the receptacle openings of the electrical outlet. A flexible strap attaches the electrically non-conductive plate to the electrically non-conductive plug. The strap is of sufficient length and flexibility to allow the plug to be removably inserted into the receptacle openings of the outlet when the electrically non-conductive plate is interposedly secured between the electrical outlet and the outlet plate.

One object of the present invention is to provide a dummy plug which, while difficult for a child to remove, may be easily removed by an adult.

A second object of the present invention is the provision of a safety cover formed of flexible non-conductive material.

Still another object of the present invention is the provision of a safety cover having prongs for insertion into the receptacle openings of the outlet to actually plug the openings.

Related objects and advantages of the present invention will be apparent from the following description.

DESCRIPTION OF THE PREFERRED EMBODIMENT

Figure 1:
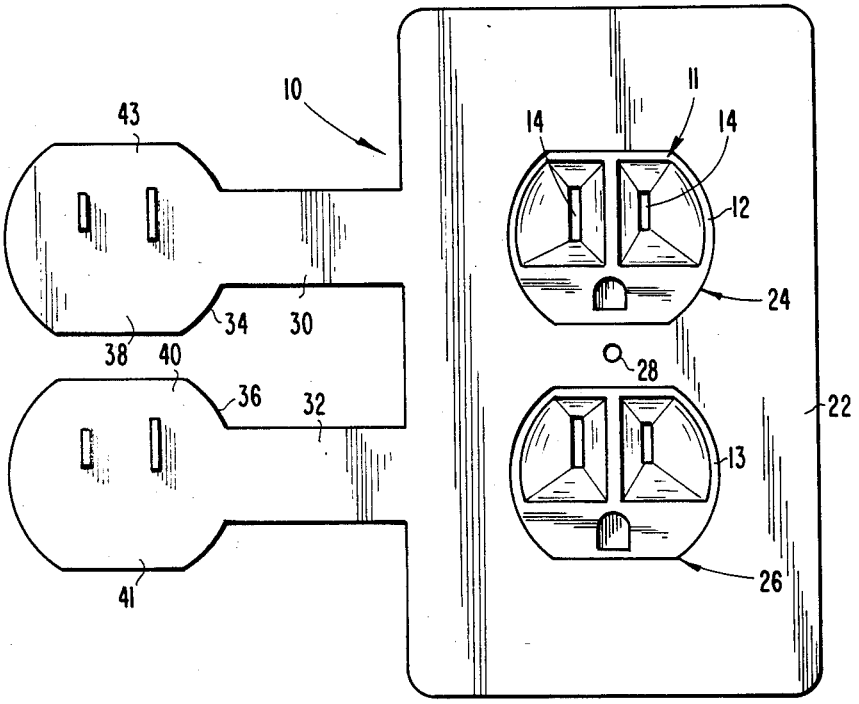
FIG. 1 is a front view of one embodiment of the present invention in position with a standard electrical wall outlet prior to the outlet plate being secured to the outlet.

For the purposes of promoting an understanding of the principles of the invention, reference will now be made to the embodiment illustrated in the drawings and specific language will be used to describe the same. It will nevertheless be understood that no limitation of the scope of the invention is thereby intended such alterations and further modifications in the illustrated device, and such further applications of the principles of the invention as illustrated therein being contemplated as would normally occur to one skilled in the art to which the invention relates.

Figure 2:
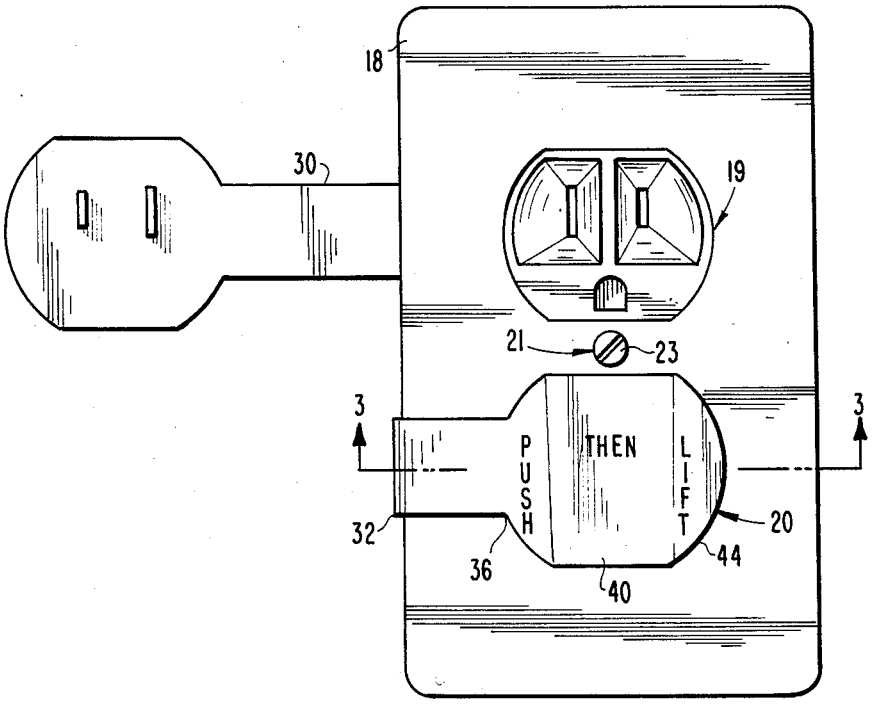
FIG. 2 is a front view of the device of the present invention after attachment of the outlet cover plate to the electrical outlet.
Figure 3:
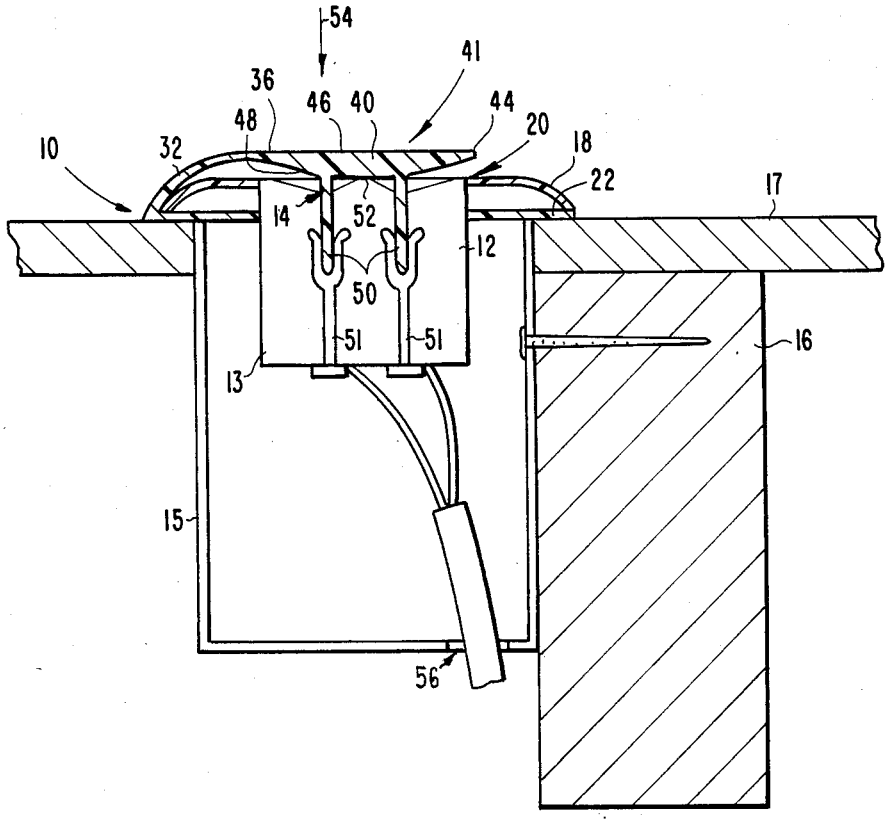
FIG. 3 is a cross-sectional view of the present invention along line 3—3 of FIG. 2.

Referring to FIGS. 1–3, there is illustrated a safety device 10 for electrical outlets. Electrical outlet 11 has two sockets 12 and 13. Sockets 12 and 13 each have receptacle openings 14 located therein. Electrical outlet 11 is secured within a junction box 15 which is secured to a stud 16 located behind the wall 17. The junction box 15 and a substantial portion of the electrical outlet 11 are typically covered by a cover plate 18 which has a pair of socket apertures 19 and 20 located in the outlet plate to allow the sockets 12 and 13 to be accessible to the electrical user. Outlet plate 18 also has an attachment aperture 21 so that a screw 23 may be used to secure the cover plate 18 to the electrical outlet 11. A standard duplex wall outlet is illustrated in the drawings and in such an outlet, attachment aperture 21 is located between socket apertures 19 and 20.

The preceding paragraph described the environment in which the safety device 10 will be used. This and the following paragraphs will more particularly describe the safety device 10 itself. Safety device 10 bas an electrically non-conductive plate 22 which has socket openings 24 and 26 and an attachment hole 28 located therein and extending therethrough. In the preferred embodiment, electrically non-conductive plate 22 is made of 0.035 inch polypropylene for its electrical insulating value and flexibility. Socket openings 24 and 26 and attachment hole 28 are located in the plate to allow sockets 12 and 13 and screw 23 to extend through the plate 22. Electrically non-conductive plate 22 is substantially rectangular in shape simulating the shape of cover plate 18. While it is possible for electrically non-conductive plate 22 to have greater dimensions than cover plate 18 in the preferred embodiment plate 22 has slightly smaller dimensions than plate 18 so that plate 22 is totally obscured by plate 18 when plate 18 is attached to outlet 11.

Extending from a side of the plate 22 are a pair of flexible straps 30 and 32. Flexible straps 30 and 32 attach to the first edge 34 and 36 of plug heads 38 and 40, respectively. As can be seen from FIGS. 2 and 3, flexible straps 30 and 32 are of sufficient length to allow plugs 41 and 43 to be removably inserted into sockets 12 and 13 when plate 22 is interposedly secured between electrical outlet 11 and outlet plate 18. From the foregoing, it should be understood that the safety device prevents loss of the dummy plugs 41 and 43 when they are removed from sockets 12 and 13 because the plugs are permanently secured to plate 22 which is semi-permanently secured to the outlet 11 and cover plate 18. Additionally, since plate 22 is interposed between plate 18 and outlet 11, a force applied to either plug 41 or 43 will not cause screw 23 to pull through attachment hole 28 since a fairly rigid cover plate 18 is interposed between screw 23 and attachment hole 28. One further advantage of the present invention is that when plugs 41 or 43 are removed from sockets 12 and 13, straps 30 and 32 swing the plugs away from the outlets 11 so as not to interfere with plugging and unplugging of electrical devices into the sockets 12 and 13.

Referring to FIG. 3 dummy plug 41 will be described, it being understood that the structure of plug head 41 is duplicated in plug head 43 (FIG. 1). As previously described dummy plug 41 has a plug head 40 which has a first edge 36. A second edge 44 is located opposite the first edge 36. Dummy plug 41 has a protective surface 46 and an oppositely facing socket contact surface 48. Prongs 50 are located on the socket contact surface and extend substantially perpendicularly from a line tangent to the lowermost portion 52 of socket contact surface 48 in a position which allows insertion of the prongs into the receptacle openings 14 of the electrical outlet 11. Prongs 50 are sized to be received in the receptacle openings 14 and are of sufficient length to separate electrical contacts 51 in electrical outlet 11.

In order to allow for easy removal by an adult of dummy plug 41 from electrical socket 12, socket contact surface 48 is curved so that the lowermost point 52 on the surface provides a pivot point 52. Because of the curved surface of socket contact surface 48, there is a space between socket contact surface 48 and the socket 12 near first edge 36 and also a space between socket contact surface 48 and socket 12 near second edge 44. Thus, when a force in the direction of arrow 54 is applied on first edge 36 of protective surface 46 plug head 40 pivots about pivot point 52 causing the space between second edge 44 and socket 12 to increase. This increase in space between second edge 44 and socket 12 allows for easy insertion of a finger or another object to allow for removal of dummy plug 41 from socket 12. As illustrated, the words "push - then - lift" may be positioned on the protective surface 46 to aid the user in removing the plug 41.

Safety device 10 may be manufactured in a unitary fashion as illustrated, or may be manufactured in separate parts and assembled. In the preferred embodiment, plate 18, straps 30 and 32 and dummy plugs 41 and 43 are all made of electrically non-conductive, flexible material such as polypropylene. One additional advantage which may be recognized by the safety device is that the device will provide a barrier to drafts which may enter junction box 15 through the wire knock-out openings 56 which are located therein, and thereby increase heat savings.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A safety device for insertion into the receptacle openings of an electrical outlet having a socket comprising:

a plug head having a protective surface, an oppositely facing socket contact surface, a first edge and a second edge located opposite said first edge;

pivot means for pivoting said second edge away from a socket in which the device is inserted when a force directed toward the socket is applied to said first edge;

a plurality of prongs extending from said socket contact surface, said prongs being positioned on said socket contact surface to be received in the receptacle openings of an electrical outlet.

2. The safety device of claim 1 wherein said socket contact surface is non-planar and has a lowermost point thereon which defines a pivot point and wherein said pivot means includes said pivot point.

3. The safety device of claim 2 wherein said pivot point is located on said outlet contact surface between said plurality of prongs.

4. The safety device of claim 1 wherein said socket contact surface is convexly curved defining a curvature to said socket contact surface and said curvature provides said pivot means.

5. The safety device of claim 4 wherein the curvature has a lowermost point defining a pivot point and said pivot point is located between said plurality of plugs.

6. The safety device of claim 5 wherein said plurality of prongs extend from said socket contact surface substantially perpendicularly to a line tangent to the lowermost point of said curvature.

7. A safety device for use with a standard wall electrical outlet that has an outlet plate with a socket aperture and an attachment aperture extending therethrough comprising:

an electrically non-conductive plate having a socket opening and an attachment hole extending therethrough, said attachment hole and said socket opening being sized and arranged to correspond with the attachment aperture and socket aperture in the outlet plate;

an electrically non-conductive plug having prongs located thereon which are positioned and sized to be received in the receptacle openings of the electrical outlet; and, a flexible strap attached to said electrically non-conductive plate and said electrically non-conductive plug, said strap being of sufficient length and flexibility to allow said plug to be removably inserted into the receptacle openings of the outlet when said electrically non-conductive plate is interposedly secured between the electrical outlet and the outlet plate.

8. The safety device of claim 7 wherein said electrically non-conductive plate is interposedly secured between the electrical outlet and the outlet plate and said strap extends from behind said plate a sufficient length to allow said plug to be removably inserted into the receptacle outlets.

9. The safety device of claim 7 wherein said plug further comprises:

a plug head having a protective surface, an oppositely facing socket contact surface, a first edge and a second edge located opposite said first edge;

pivot means for pivoting said second edge away from a socket in which the device is inserted when a force directed toward the socket is applied to said first edge;

a plurality of prongs extending from said socket contact surface, said prongs being positioned on said socket contact surface to be received in receptacle openings of an electrical outlet.

10. The safety device of claim 9 wherein said strap is attached to said first edge of said plug head.

* * * * *